US005572844A

United States Patent [19]

Stackenwalt et al.

[11] Patent Number: 5,572,844

[45] Date of Patent: Nov. 12, 1996

[54] RUNNER-TRIM CONNECTOR

[75] Inventors: Richard D. Stackenwalt, Dallastown; Brian E. Witmyer, Lititz, both of Pa.

[73] Assignee: Armstrong World Industries, Inc., Lancaster, Pa.

[21] Appl. No.: 426,831

[22] Filed: Apr. 24, 1995

[51] Int. Cl.[6] ..... E04D 5/00

[52] U.S. Cl. ..... 52/506.07; 52/506.08; 52/665; 52/714

[58] Field of Search ..... 52/665, 506.06, 52/506.07, 506.08, 506.09, 506.1, 714, 584.1; 403/252, 258, 259

[56] References Cited

U.S. PATENT DOCUMENTS

| | | | |
|---|---|---|---|
| 2,867,857 | 1/1959 | McCarthy | 52/584.1 |
| 4,043,689 | 8/1977 | Spencer et al. | 403/252 |
| 5,046,924 | 9/1991 | Platt | 52/665 X |

*Primary Examiner*—Carl D. Friedman
*Assistant Examiner*—David J. Jersen

[57] ABSTRACT

A suspended ceiling system having a trim strip and ceiling runners. A trim connector fastens the trim strip to the ceiling runners. The trim connector being a two part structure is fastened to the trim strip by a releasable fastening action. One of the two parts of the trim connector is also fastened to the ceiling runner.

1 Claim, 1 Drawing Sheet

RUNNER-TRIM CONNECTOR

BACKGROUND OF THE INVENTION

1. Field of the Invention

The invention relates to a connector for connecting together a conventional ceiling runner with a decorative trim for the edge of a suspended ceiling system.

2. Description of the Prior Art

U.S. Pat Nos. 3,798,865 and 5,195,289 disclose a clip means which secures a ceiling grid member to a wall member. In U.S. Pat. No. 3,798,865, a slide lock clip means 30 is used in a ceiling grid structure for securing cross members 16 to wall members 12. The structure of the patent pinches the cross members of the ceiling structure and engages grooves in a trim member without the use of any positive fastening means to hold the clip to the trim means. In U.S. Pat. No. 5,195,289, a clip 23 pinches the cross members of the ceiling structure and also engages grooves in the trim strip without a means for locking the connector means to the trim strip.

U.S. Pat. No. 3,998,419 discloses a connector used in suspended ceiling structures having a two piece slide lock design. The patent fails to disclose a connector clip secured to a trim strip by pinching a protrusion on the trim strip when a screw connecting the two piece connector clip is tightened.

The object of the invention herein is to have a positive engagement of the connector with both the ceiling runner of the suspended ceiling system and the trim strip which is used as a decorative edge to the ceiling suspension structure.

SUMMARY OF THE INVENTION

The invention is directed to a suspended ceiling trim connector which will mount the trim strips of the suspended ceiling system onto the grid tee members (inverted T-shaped runner) of the suspended ceiling system. The trim strip is positioned along the exposed edges of the suspended ceiling system. The grid forming the interconnected grid tee members which form the suspended ceiling system are not extended all the way to the walls of a structure and, therefore, need the trim strip to cover up the "raw" edges of the suspended ceiling system. The tee members, which are conventional ceiling grid members, have vertical central portions and flanges extending in opposite directions from the lower edge of said vertical central portion. The trim connector comprises a first part adapted to be connected to said vertical central portion of the grid tee members. A second part is a vertically extending second portion. The second portion interlocks with the trim strip. The improvement herein comprises the use of a trim connector having a two part structure joined together with a separate fastening means. The trim strip has a face portion and a back portion with upper and lower ribs forming upper and lower channels on the back portion adjacent the tee members. One part of said trim connector is positioned in the upper and lower channels of the trim strip. The second part of the trim connector is positioned adjacent a rib which forms one of the two upper or lower channels. This results in the first and second part of the trim connector being positioned on either side of a rib of the trim strip. A fastening means interconnects the two parts forcing the two parts together to pinch the rib of the trim strip holding those parts in position on the trim strip. The other portion of the trim connector is placed adjacent the vertical central portion of the tee members and is fastened thereto by appropriate fastening means.

DESCRIPTION OF THE PREFERRED EMBODIMENT

Figure 1:
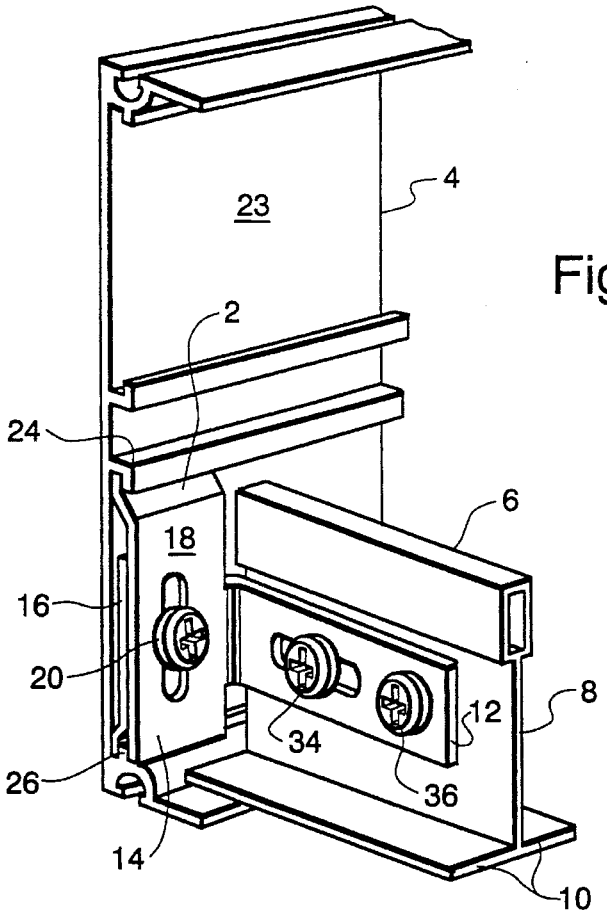
FIG. 1 is a perspective view of the invention showing the trim strip and the trim connector fastened to a conventional inverted T-shaped runner.
Figure 2:
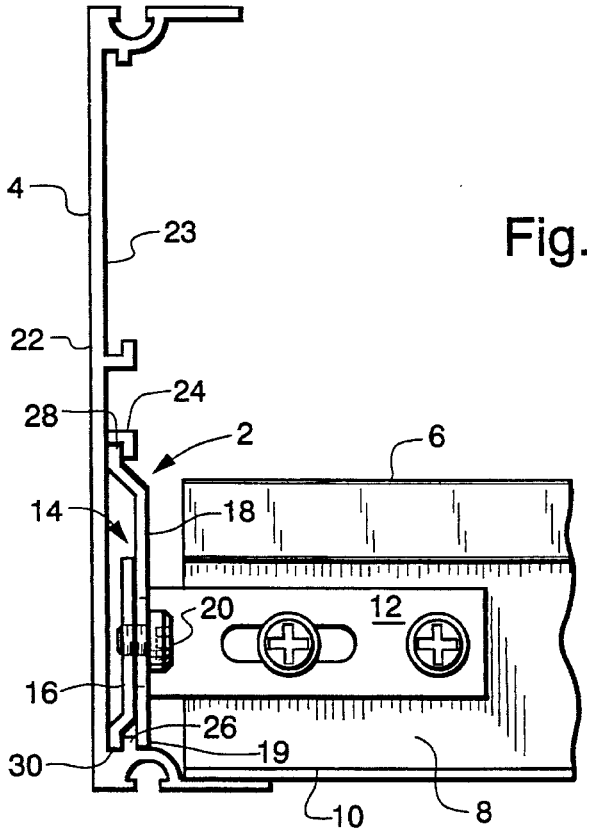
FIG. 2 is a side view of the structure of FIG. 1.

The invention is shown in FIGS. 1 and 2. A suspended ceiling trim connector 2 is used for mounting trim strips 4 on ceiling grid tee members 6 along the exposed edges of the suspended ceiling tee members which form an interconnected pattern of grid tee members. The suspended ceiling system is not extended from wall to wall within an area but stops short of the walls and, therefore, has exposed edges which must be concealed with the decorative trim strips. The grid tee members 6 have a vertical section 8 and flanges 10 extending in opposite directions from the lower edge of the vertical central portion 8. The trim connector is formed of a first part 12 adapted to be connected to said vertical central portion of the grid tee members 6 and a vertically extending second portion 14. The second portion 14 interlocks with said trim strips 4.

The improvement herein comprises a trim connector 2 made of a two part structure, elements 16 and 18. The two structures 16 and 18 are joined together with a separate fastening means 20. Part 12 and structure 18 are one piece of material (i.e. metal or plastic). The trim strip 4 has a face portion 22 which is generally a smooth surface and a back portion with upper and lower ribs 24 and 26. As shown in FIG. 1, there can be two sets of upper and lower ribs and in FIG. 2, there is shown only the use of a single set of upper and lower ribs. The ribs form upper and lower channels 28 and 30 on the back side 23 of the trim strip 4. One part 16 of the trim connector is positioned in one of said upper or lower channels. They are shown in the drawings as being placed in the lower channel 30. The second part 18 of the trim connector has its one end 19 adjacent the rib forming the channel receiving the one part of the trim connector. As shown in the figures, the lower portion of part 18 is positioned adjacent rib 26 and the lower portion of part 16 is in the channel 30. The separate fastening means 20 forces the one part 16 and the second part 18 of the trim connector 2 together to pinch rib 26 of channel 30 to hold the one part 16 firmly in place with the pinching of rib 26 to hold the trim connector in place on the trim strip. This pinching action is best seen in FIG. 2 at the lower portion of the trim strip.

The trim connector 2 is fastened to the vertical central portion of the grid tee member. The first part 12 is positioned against the vertical central portion of the grid tee member and fastening means 34 and 36 rigidly fasten these two elements together.

As shown quite clearly in FIG. 2, the first part 16 of the trim connector has its lower portion positioned in channel 30. The second part 18 has its upper portion positioned in channel 28. The lower portion of the second part 18 is positioned adjacent rib 26 so that rib 26 is now between the lower portion of both the first part 16 and the second part 18. With the tightening of the fastening means 20, the rib 26 will be pinched therebetween and this, in turn, will hold the parts 16 and 18 of the trim connector so that it cannot freely slide back and forth in the channels 28 and 30.

What is claimed is:

1. A suspension ceiling comprising at least one grid tee with an exposed edge along at least one portion thereof spaced from an adjacent wall, said grid tee including a central web with oppositely extending flanges along the lower portion of said web, trim connector mounted on said grid tee at the exposed edge thereof, a trim strip having a face portion and a back portion, said trim connector mounted on said trim strip, the improvement comprising said trim connector being a two part structure joined together with a separate fastener means, said trim strip back portion having upper and lower ribs forming upper and lower channels on the back portion of the trim strip, said one part of said trim connector being in one of said upper or lower channels, said second part of said trim connector being adjacent the rib forming the channel receiving said one part of said trim connector, the separate fastener means forcing said one part and said second part of the trim connector together to pinch the rib of the channel holding the one part in place with the pinching of the rib holding the trim connector in place on the trim strip.

* * * * *